US009683194B2

(12) United States Patent
Davies et al.

(10) Patent No.: US 9,683,194 B2
(45) **Date of Patent: *Jun. 20, 2017**

(54) QUATERNARY AMMONIUM SALT CONTAINING COMPOSITIONS THAT PROVIDE BALANCED DEPOSIT CONTROL AND WEAR PERFORMANCE WITHOUT SEAL COMPATIBILITY ISSUES

(71) Applicant: The Lubrizol Corporation, Wickliffe, OH (US)

(72) Inventors: Mark C. Davies, Belper (GB); Ewan E. Delbridge, Concord Township, OH (US); Matthew D. Gieselman, Wickliffe, OH (US); Colin J. H. Morton, Singapore (SG)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/424,485

(22) PCT Filed: Aug. 19, 2013

(86) PCT No.: PCT/US2013/055519

§ 371 (c)(1),
(2) Date: Feb. 27, 2015

(87) PCT Pub. No.: WO2014/042823

PCT Pub. Date: Mar. 20, 2014

(65) Prior Publication Data

US 2015/0210953 A1 Jul. 30, 2015

Related U.S. Application Data

(60) Provisional application No. 61/699,321, filed on Sep. 11, 2012.

(51) Int. Cl.

| | |
|---|---|
| ***C10M 137/10*** | (2006.01) |
| ***C10M 169/04*** | (2006.01) |
| ***C10M 133/26*** | (2006.01) |
| ***C10M 141/10*** | (2006.01) |
| ***C10M 161/00*** | (2006.01) |

(52) U.S. Cl.

CPC ..... *C10M 141/10* (2013.01); *C10M 161/00* (2013.01); *C10M 2207/026* (2013.01); *C10M 2207/028* (2013.01); *C10M 2207/289* (2013.01); *C10M 2209/102* (2013.01); *C10M 2215/04* (2013.01); *C10M 2215/042* (2013.01); *C10M 2215/064* (2013.01); *C10M 2215/082* (2013.01); *C10M 2215/28* (2013.01); *C10M 2219/00* (2013.01); *C10M 2219/046* (2013.01); *C10M 2219/087* (2013.01); *C10M 2223/04* (2013.01); *C10M 2223/043* (2013.01); *C10M 2223/045* (2013.01); *C10M 2223/049* (2013.01); *C10M 2227/061* (2013.01); *C10N 2230/04* (2013.01); *C10N 2230/06* (2013.01); *C10N 2230/36* (2013.01); *C10N 2240/10* (2013.01); *C10N 2260/09* (2013.01)

(58) Field of Classification Search

None

See application file for complete search history.

(56) References Cited

U.S. PATENT DOCUMENTS

| | | | | |
|---|---|---|---|---|
| 7,951,211 | B2 | 5/2011 | Barton et al. | |
| 2008/0026973 | A1* | 1/2008 | Nelson | C10M 141/06 508/547 |
| 2008/0113890 | A1 | 5/2008 | Moreton et al. | |
| 2012/0138004 | A1 | 6/2012 | Stevenson et al. | |
| 2012/0214718 | A1* | 8/2012 | Najman | C10M 141/08 508/192 |

FOREIGN PATENT DOCUMENTS

| | | |
|---|---|---|
| WO | 2010149712 A1 | 12/2010 |
| WO | 2012087773 A1 | 6/2012 |

OTHER PUBLICATIONS

Written Opinion of the Corresponding International Application No. PCT/US13/055519 dated Oct. 9, 2013.

Search Report of the Corresponding International Application No. PCT/US13/055519 dated Oct. 9, 2013.

Corresponding International Publication No. WO/2014/042823 A1 Published Mar. 20, 2014.

* cited by examiner

*Primary Examiner* — Vishal Vasisth

(74) *Attorney, Agent, or Firm* — Christopher D. Hilker; David M. Shold; Teresan W. Gilbert

(57) ABSTRACT

The invention relates to lubricating compositions, processes of making such lubricating compositions, and method of using such lubricating compositions. The lubricating compositions of the present invention include a dispersant comprising a quaternary ammonium salt, a phosphorus-containing compound, a metal dialkyldithiophosphate, a derivative of a hydroxyl carbonyl compound and an amine and/or an alcohol. These compositions provide balanced deposit control and wear performance without causing any seal compatibility issues.

9 Claims, No Drawings

QUATERNARY AMMONIUM SALT CONTAINING COMPOSITIONS THAT PROVIDE BALANCED DEPOSIT CONTROL AND WEAR PERFORMANCE WITHOUT SEAL COMPATIBILITY ISSUES

This application is a 371 of PCT/US2013/055519, filed Aug. 19, 2013 which claims benefit of 61/699,321, filed Sept. 11, 2012.

FIELD OF THE INVENTION

The invention relates to lubricating compositions, processes of making such lubricating compositions, and method of using such lubricating compositions. The lubricating compositions of the present invention include a dispersant comprising a quaternary ammonium salt, a phosphorus-containing compound, a metal dialkyldithiophosphate, a derivative of a hydroxy-carboxylic acid and an amine and/or an alcohol. These compositions provide balanced deposit control and wear performance without causing any seal compatibility issues.

BACKGROUND OF THE INVENTION

Traditional state of the art engine oil lubricants often use dialkyldithiophosphate (ZDP) antiwear additives to protect the components of engine in which the oil lubricants are used from high levels of wear. In addition oil lubricants also generally contain ashless dispersants to handle soot and sludge.

A relatively new class of dispersants, those comprising a quaternary ammonium salt, are becoming increasingly important due to their outstanding soot handling and sludge control properties. Such materials are known in the art and are described in references such as U.S. Pat. Nos. 7,951,211 and 7,906,470, and US patent applications 2008/0113890, 2012/0138004, to name a few.

However, in some instances the use these quaternary ammonium salts in combination with dialkyldithiophosphate antiwear additives, especially in high temperature applications, may lead to mixtures that do not have good seal and/or elastomer compatibility, especially with fluoro elastomers. It is believed that these materials may interact with one another to result in materials that may degrade or even destroy fluoroelastomers, including seals made from such fluoroelastomers. Fluoroelastomers are fluorocarbon-based synthetic rubbers and are considered to generally have good chemical resistance and physical properties, including under high temperature conditions. Thus such materials are widely used to make seals. Examples of specific fluoroelastomers include copolymers and/or terpolymers of hexafluoropropylene, vinylidene fluoride, tetrafluoroethylene, and perfluoromethylvinylether. Such materials include those marketed under the Viton® trade name by DuPont™. This issue with using quaternary ammonium salt dispersant in combination with dialkyldithiophosphate antiwear additives may limit how broadly this new class of quaternary ammonium salt dispersants may be used or force oil lubricant users to remove dialkyldithiophosphate antiwear additives, leading to wear problems.

There is need for a lubricating composition that uses quaternary ammonium salt dispersants in combination with dialkyldithiophosphate antiwear additives while providing a balance of deposit control, wear performance, and seal compatibility. The present invention does just that.

SUMMARY OF THE INVENTION

The invention provides an additive composition comprising: (a) a dispersant comprising a quaternary ammonium salt; (b) a metal dialkyldithiophosphate; (c) a phosphorus-containing compound that is not a metal dialkyldithiophosphate; and (d) a derivative of an hydroxyl carbonyl compound (for example a hydroxy-carboxylic acid) and an amine and/or an alcohol.

The dispersant of component (a) may be a quaternary ammonium salt, or rather it may be a dispersant component that includes a quaternary ammonium salt. The dispersant may also be described as a compound containing a quaternary ammonium salt functional group. The quaternary ammonium salt of component (a) may comprise the reaction product of: (i) a compound comprising at least one tertiary amino group; and (ii) a quaternizing agent suitable for converting the tertiary amino group of compound (i) to a quaternary nitrogen. In some embodiments component (a) comprises the reaction product of (i) the reaction product of a polyhydroxy stearic acid and a polyamine where the resulting product has at least one tertiary amino group or at least one amino group that may be alkylated to a tertiary amino group; and (ii) a quaternizing agent suitable for converting the tertiary amino group of compound, and wherein component (a) may optionally further comprises a polyhydroxy stearic acid.

The metal dialkyldithiophosphate of component (b) may comprise a zinc dialkyldithiophosphate, and the alkyl groups of such zinc dialkyldithiophosphates may each be branched and contain from 3 to 12 carbon atoms.

The phosphorus-containing compound of component (c) may comprise an alkyl phosphite, a phosphoric acid ester, an amine salt of a phosphoric acid ester, or some combination thereof.

The derivative of a hydroxy-carboxylic acid and an amine and/or an alcohol of component (d) may comprise a compound derived from a hydroxyl carbonyl compound, for example a hydroxy-carboxylic acid, and in some embodiments a hydroxy-carboxylic acid represented by Formula (I).

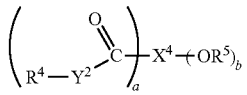

(I)

wherein: a and b may be independently integers of 1 to 5; $X^4$ may be an aliphatic or alicyclic group, or an aliphatic or alicyclic group containing an oxygen atom in the carbon chain, or a substituted group of the foregoing types, said group containing up to 6 carbon atoms and having a+b available points of attachment; each $Y^2$ may be independently —O—, >NH, or >$NR^6$ or two Ys together representing the nitrogen of an imide structure $R^4$—N< formed between two carbonyl groups; and each $R^4$ and $R^6$ may be independently hydrogen or a hydrocarbyl group, provided that at least one $R^4$ and $R^6$ group may be a hydrocarbyl group; each $R^5$ may be independently hydrogen, a hydrocarbyl group or an acyl group, further provided that at least one —$OR^5$ group is located on a carbon atom within $X^4$ that is α or β to at least one of the —C(O)—$Y^2$—$R^1$ groups, and further provided that at least on $R^5$ is hydrogen.

In of the embodiments described herein, the weight ratio of component (c) to component (b) may be at least 1.5:1. In such embodiments it should be clear that the amount of component (b), the metal dialkyldithiophosphate, is being reduced and replaced with component (c), the phosphorus-containing compound that is not a metal dialkyldithiophosphate, while balancing the impact this has not only on any seal compatibility issues that may be caused by interactions between components (a) and (b), but also the performance provided to the composition by each of the various component on their own. This overall balancing of components allows the present invention to provide a composition that provides the deposit control performance of component (a), the antiwear performance of component (c), as well as the benefits of components (b) and (d) but without any of the seal compatibility issues that are often seen when components (a) and (b) are used together. In some embodiments at least 40% of the phosphorus present in the overall composition is delivered by component (c), that is, at least that portion of phosphorus in the composition is not from a metal dialkyldithiophosphate. In some embodiments the portion of phosphorus present in the overall composition delivered by component (c) is at least 50%, or even at least 60%, or even at least 70%. In any of these embodiments the minimum percent may be applied to all sources of phosphorus in the composition, or they may be applied to the phosphorus delivered by components (b) and (c) only.

The compositions of the invention may further include one or more antioxidants, one or more detergents, one or more friction modifiers other than component (d), one or more pour point depressants, one or more viscosity modifiers, one or more antifoam agents, one or more dispersants other than component (a), one or more antiwear agents other than components (b) and (c), or any combination thereof.

The compositions described herein may be additive compositions and/or concentrates which include the combination of additives described and a small amount of an oil of lubricating viscosity. The compositions described herein may be lubricant compositions and/or lubricating compositions which include the combination of additives described and a major amount of an oil of lubricating viscosity.

The invention also provides for a method of lubricating an internal combustion engine comprising the step of supplying to an internal combustion engine any of the lubricant compositions described herein.

The invention also provides a method of improving the overall performance of a lubricant composition balanced across the areas of deposit control, seal compatibility, and antiwear, where the method comprises the step of adding to said lubricant any of the additive compositions described herein.

The invention also provides the use of an additive composition to improve the seal performance of a quaternary ammonium salt containing composition, wherein said additive composition includes (a) a dispersant comprising a quaternary ammonium salt; (b) a metal dialkyldithiophosphate; (b) a phosphorus-containing compound that is not a metal dialkyldithiophosphate; and (d) a derivative of a hydroxyl carbonyl compound (for example a hydroxy-carboxylic acid) and an amine and/or an alcohol.

DETAILED DESCRIPTION OF THE INVENTION

Various features and embodiments of the invention will be described below by way of non-limiting illustration.

The Additive and Lubricant Compositions

The present invention provides additives compositions that include (a) a dispersant comprising a quaternary ammonium salt; (b) a metal dialkyldithiophosphate; (c) a phosphorus-containing compound that is not a metal dialkyldithiophosphate; and (d) a derivative of an hydroxyl carbonyl compound (for example a hydroxy-carboxylic acid) and an amine and/or an alcohol. These additive compositions, which may also be referred to as additive concentrates, often also include some amount of an oil of lubricant viscosity, for example a mineral oil, or some other diluent, such as a solvent, to allow for good handling properties and the like. In addition, these additive compositions may contain one or more additional additives, as described below.

The present invention provides lubricant compositions, which may also be referred to as lubricating compositions that include any of the additive compositions described above and a major amount of an oil of lubricating viscosity. In addition, these lubricant compositions may contain one or more additional additives, as described below.

In some embodiments the compositions of the invention are lubricating compositions that include: component (a) from 0.1 to 10, or from 0.2 to 8, or from 0.3 to 5, or from 0.4 to 4, or from 0.45 to 3.90, or from 1 or 1.5 to 2 or 2.5 percent by weight of the overall composition on an oil free basis; component (b) from 0.1 to 5.0, or from 0.1 to 1.5, or from 0.25 to 1.0, or from 0.3 to 0.5, or even about 0.4 or even 0.38 percent by weight of the overall composition on an oil free basis; component (c) from 0.1 to 5.0, or from 0.5 to 1.5, or from 0.5 to 1.0, or from 0.7 to 0.9, or even about 0.8 or even 0.83 percent by weight of the overall composition on an oil free basis; and/or component (d) from 0.1 to 5.0, or from 0.1 to 1.0, or from 0.25 to 0.75, or from 0.4 to 0.6, or even about 0.5 percent by weight of the overall composition on an oil free basis. The amounts of components (b) and (c) may instead be described in regards to the amount of phosphorus they deliver to the composition. Components (b) and (c) may each be present such that the components, when considered individually or together, delivers from 50 to 2000, or from 100 to 1200, or from 200 to 900, or from 1 to 600, or from 400 to 1000 ppm of phosphorus to the composition. In any of these embodiments a non-quaternized ashless dispersant, as described below, may also be present. In such embodiments the non-quaternized ashless dispersant may be present from 0.1 to 10, or from 1.0 to 5.0, or from 1.0 to 3.0, or from 1.3 to 2.9, or from 1.4 to 2.8 percent by weight of the overall composition on an oil free basis. In some embodiments one may also consider the total dispersant treat rate, that is, the combined treat rate of the quaternized dispersant as well as any non-quaternized dispersant that may be present. In such embodiments the total dispersant treat rate can be from 1 to 12, from 2 to 8, or from 2 to 6 percent by weight of the overall composition. The balance of these lubricating compositions may be one or more additional additives, as described below, and a major amount of lubricating oil including any diluent oil or similar material carried into the composition from one or more of the components described herein.

In some embodiments the compositions of the invention are additive compositions, which may also be referred to as additive concentrates, that include: component (a) from 1 to 30, or from 3 to 26, or from 1 to 12, or from 1.0, 2.0. 3.0 or 5.0 up to 12, 15, 25, or 30, or even from 1.5, 3, or 6 up to 11, 12, 23, or 26 percent by weight of the overall composition on an oil free basis; component (b) from 0.5 to 5.0, or from 0.1. 0.5 or 1.0 up to 2.5, 3.0, or even 5.0, or from 1.0 to 3.0, or from 1.2 to 2.6 percent by weight of the overall composition on an oil free basis; component (c) from 1 to 10, or from 1.5, 2.0 or even 2.6 up to 5.5, 6.0 or even 10, or from 2.0 to 6.0, or from 2.5 to 5.5 percent by weight of the overall composition on an oil free basis; and/or component (d) from 0.5 to 10, or from 1 to 5, or from 1 to 4, or from 1.5 to 3.5, or from 1.6 to 3.4 percent by weight of the overall composition on an oil free basis. In any of these embodiments a non-quaternized ashless dispersant, as described below, may also be present. In such embodiments the non-quaternized ashless dispersant may be present from 0.1 to 30, or from 0.1, 0.5, 1, 2, 4, 8, or 9 up to 6, 8, 10, 20, or even 30, or from 4 to 20, or from 4.4 to 18.8 percent by weight of the overall composition on an oil free basis. The balance of these lubricating compositions may be one or more additional additives, as described below, and a minor amount of lubricating oil including any diluent oil or similar material carried into the composition from one or more of the components described herein.

In of the embodiments described herein, the weight ratio of component (c) to component (b) may be at least 1.5:1, where there will always be at least 1.5 times as much component (c) present as there is component (b). In some embodiments, the lubricating compositions of the invention will not contain more than 0.9 percent by weight component (b), or will contain less than 0.8, or even no more than 0.5, or even 0.4 percent by weight component (b), with regards to the overall composition on an oil free basis.

In some embodiments, the additive compositions of the invention will not contain more than 5.0 percent by weight component (b), or will contain less than 4.0, or even no more than 3.0, or even 2.8, 2.0 or 1.5 percent by weight component (b), with regards to the overall composition on an oil free basis.

Component (a)

The compositions of the invention include a dispersant comprising a quaternary ammonium salt. The quaternary ammonium salts of the present invention include the reaction product of: (i) a compound comprising at least one tertiary amino group; and (ii) a quaternizing agent suitable for converting the tertiary amino group of compound (i) to a quaternary nitrogen. Various embodiments of suitable quaternary ammonium salts are described herein and the invention contemplates the use of any one of them or combination thereof.

Examples of suitable quaternary ammonium salts include (i) imide quaternary ammonium salts, (ii) Mannich quaternary ammonium salts, (iii) polyalkene substituted amine quaternary ammonium salts, (iv) amide quaternary ammonium salts, (v) ester quaternary ammonium salts, (vi) polyester quaternary ammonium salts, or (vii) any combination thereof.

These various types of quaternary ammonium salts may be prepared in any number of ways but generally are prepared by reacting a non-quaternized nitrogen-containing compound with a quaternizing agent. Each of the different types of quaternary ammonium salts described uses a different non-quaternized nitrogen-containing compound in its preparation, but generally the non-quaternized nitrogen-containing compound contains a tertiary nitrogen capable of being quaternized (or a primary or secondary nitrogen atom that can be alkylated to a tertiary nitrogen that can then be quaternized) and a hydrocarbyl substituent group. The non-quaternized compounds are typically detergents and/or dispersants themselves, put once converted to quaternary ammonium salts, can provide improved performance.

In some embodiments the non-quaternized nitrogen-containing compound is (i) an imide containing detergent and/or dispersant, for example a succinimide detergent and/or dispersant derived from a hydrocarbyl substituted acylating agent and a polyamine where the detergent and/or dispersant contains a tertiary amine, (ii) a Mannich detergent and/or dispersant, for example a Mannich detergent and/or dispersant derived from a hydrocarbyl substituted phenol, an aldehyde, typically formaldehyde, and a polyamine where the Mannich detergent and/or dispersant contains a tertiary amine, (iii) a polyalkene-substituted amine detergent and/or dispersant, for example a polyalkene-substituted amine detergent and/or dispersant derived from an olefin polymer and a polyamine where the polyalkene-substituted amine detergent and/or dispersant contains a tertiary amine, (iv) an amide containing detergent and/or dispersant, for example succinamide detergent and/or dispersant derived from a hydrocarbyl substituted acylating agent and a polyamine where the detergent and/or dispersant contains a tertiary amine, (v) an ester containing detergent and/or dispersant, for example succinate detergent and/or dispersant derived from a hydrocarbyl substituted acylating agent and a compound containing an oxygen atom that also contains a tertiary nitrogen, where the oxygen reacts with the agent to form the ester group and the resulting detergent and/or dispersant contains a tertiary amine, (vi) a polyester detergent and/or dispersant, for example a polyester prepared by reacting a fatty carboxylic acid containing at least one hydroxyl group and a polyamine, or (vii) any combination thereof.

The hydrocarbyl substituent groups of the quaternary ammonium salt detergents and/or dispersants, and/or of the non-quaternized nitrogen-containing compounds from which they are prepared, are not overly limited and may be any of the hydrocarbyl substituent groups derived herein. In some embodiments the hydrocarbyl substituent groups are derived from a polyolefin for example polyisobutylene. In some of these embodiments the hydrocarbyl substituent group is derived from a high-vinylidene polyisobutylene. The hydrocarbyl substituent groups can have a number average molecular weight of from 500 to 5000, or from 600 to 3000, or from 1000 to 2000. In other embodiments, for example some of the Mannich quaternary ammonium salt embodiments where the hydrocarbyl group is present on a phenol, the hydrocarbyl group can be derived from an olefin or a polyolefin, including for example alpha-olefins, such as 1-decene. In these embodiments the hydrocarbyl group may contain from 10 to 400, or from 30 to 180, or from 10 or 40 to 110.

Each of the quaternary ammonium salts described above is prepared using a quaternizing agent. Suitable quaternizing agents are not overly limited so long as they are able to convert the tertiary nitrogen of the non-quaternized precursor to a quaternized nitrogen.

Suitable quaternizing agents include dialkyl sulfates, benzyl halides, hydrocarbyl substituted carbonates, hydrocarbyl epoxides, esters of certain polycarboxylic acids, or mixtures thereof. Any of the these agents, including the hydrocarbyl epoxides and hydrocarbyl substituted carbonates, may be used in combination with an acid, for example acetic acid. Suitable acids include carboxylic acids, such as acetic acid, propionic acid, 2-ethylhexanoic acid, and the like. In some embodiments, including for example the amide quaternary ammonium salts, the quaternizing agents, including the hydrocarbyl epoxides and hydrocarbyl substituted carbonates, are used without the addition of such an acid. In some embodiments, particularly when no acid is used, some amount of water is present during the reaction.

Examples of various agents include chloride, iodide or bromide; hydroxides; sulfonates; alkyl sulfates such as dimethyl sulfate; sultones; phosphates; $C_{1-12}$ alkylphosphates; di-$C_{1-12}$ alkylphosphates; borates; $C_{1-12}$ alkylborates;

nitrites; nitrates; carbonates; bicarbonates; alkanoates; O,O-di-$C_{1-12}$ alkyldithiophosphates; or mixtures thereof. In one embodiment the quaternizing agent may be: a dialkyl sulfate such as dimethyl sulfate; N-oxides; sultones such as propane or butane sultone; alkyl, acyl or aralkyl halides such as methyl and ethyl chloride, bromide or iodide or benzyl chloride; hydrocarbyl (or alkyl) substituted carbonates; or combinations thereof. If the aralkyl halide is benzyl chloride, the aromatic ring is optionally further substituted with alkyl or alkenyl groups. The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxides, as represented by Formula (II).

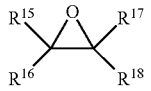

(II)

wherein $R^{15}$, $R^{16}$, $R^{17}$ and $R^{18}$ can be independently H or a $C_{1-50}$ hydrocarbyl group. Examples of suitable hydrocarbyl epoxides include: styrene oxide, ethylene oxide, propylene oxide, butylene oxide, stilbene oxide, $C_{2-50}$ epoxides, or combinations thereof.

With regards to the amide quaternary ammonium salt described above, the presence of the amide group and its impact on the rest of the structure allows the salt to be "self-salting" and thus not requiring of a separate anion assuming the structure also includes at least one other acid group. For example when hydrocarbyl substituted succinic anhydrides, and similar materials are used to prepare the non-quaternized nitrogen-containing compounds, the resulting quaternary ammonium salt can have an amide group and an acid group, where the acid group becomes the counter anion for the quaternized nitrogen or the resulting amide quaternary ammonium salt. These materials may be described as betaines. The preparation of these quaternary ammonium salts is typically marked by the use of an alkylene oxide quaternizing agent, or a similar agent, without the addition of a separate acid.

In another embodiment the quaternizing agent can be an ester of a carboxylic acid or an ester of a polycarboxylic acid. In a general sense such materials may be described as compounds having the structure of Formula (III)

$$R^{19}—C(=O)—O—R^{20} \quad \text{(III)}$$

where $R^{19}$ is an optionally substituted alkyl, alkenyl, aryl or alkylaryl group and $R^{20}$ is a hydrocarbyl group containing from 1 to 22 carbon atoms. Suitable compounds include esters of carboxylic acids having a pKa of 3.5 or less. In some embodiments $R^{19}$ may contain one or more additional ester groups, each of which may independently have the structure —C(=O)—O—$R^{20}$. In some embodiments the compound is a diester.

In some embodiments the compound is an ester of a carboxylic acid selected from a substituted aromatic carboxylic acid, an alpha-hydroxycarboxylic acid and a polycarboxylic acid, thus $R^{19}$ can be a substituted aryl group and $R^{20}$ may be an alkyl or alkylaryl group. In some embodiments the quaternizing agent is methyl salicylate. In some embodiments the quaternizing agent is an ester of an alpha-hydroxycarboxylic acid. Compounds of this type suitable for use herein are described in EP 1254889 and include methyl 2-hydroxyisobutyrate. In some embodiments the quaternizing agent comprises an ester of a polycarboxylic acid including dicarboxylic acids and carboxylic acids having more than 2 acidic moieties. Suitable example include diesters of oxalic acid, diesters of phthalic acid, diesters of maleic acid, diesters of malonic acid or diesters or triesters of citric acid. In some embodiments the quaternizing agent includes dimethyl oxalate, methyl 2-nitrobenzoate and methyl salicylate.

In some embodiments the quaternary ammonium salt is a quaternized polymer formed by polymerizing the condensation product of a hydrocarbyl-substituted acylating agent and a compound having an oxygen or nitrogen atom capable of condensing the acylating agent wherein the condensation product has at least one tertiary amino group, or even polymerizing the hydrocarbyl-substituted acylating agent which is then reacted with a compound having an oxygen or nitrogen atom. One or more of the tertiary amino groups on the polymer may then be quaternized using the methods described herein resulting in a quaternized polymer.

Any of the quaternary ammonium salts described above may be derived in the presence of a protic solvent. In some embodiments the process used to prepare these additives is substantially free of to free of methanol. Substantially free of methanol can mean less than 0.5, 0.1 or 0.05 percent by weight methanol in the reaction mixture, or even completely free of methanol. Suitable protic solvents include solvents that have dielectric constants of greater than 9. In one embodiment the protic solvent includes compounds that contain 1 or more hydroxyl functional groups, and may include water. In some embodiments the protic solvent is water.

In one embodiment, the solvents are glycols and glycol ethers or certain alcohols. In one embodiment, these alcohols contain at least 2 carbon atoms, and in other embodiments at least 4, at least 6 or at least 8 carbon atoms. In one embodiment the solvent of the present invention includes 2-ethylhexanol.

The solvent can be any of the commercially available alcohols or mixtures of such alcohols and also includes such alcohols and mixtures of alcohols mixed with water. In some embodiments the amount of water present may be above 1 percent by weight of the solvent mixture. In other embodiments the solvent mixture may contain traces of water, with the water content being less than 1 or 0.5 percent by weight.

In some embodiments the quaternary ammonium salt comprises the reaction product of: (i) a compound comprising at least one tertiary amino group; and (ii) a quaternizing agent suitable for converting the tertiary amino group of compound (i) to a quaternary nitrogen.

In some embodiments component (a) comprises the reaction product of (i) the reaction product of a polyhydroxy stearic acid and a polyamine where the resulting product has at least one tertiary amino group or at least one amino group that may be alkylated to a tertiary amino group; and (ii) a quaternizing agent suitable for converting the tertiary amino group of compound, and wherein component (a) may optionally further comprises a polyhydroxy stearic acid. When such mixtures are used, component (a) may be anywhere from 10 to 90 percent by weight quaternized dispersant and 90 to 10 percent by weight polyhydroxy stearic acid. In some embodiments component (a) is 10 to 30 percent by weight quaternized dispersant and 90 to 70 percent by weight polyhydroxy stearic acid, or even 10 to 25 percent by weight quaternized dispersant and 90 to 75 percent by weight polyhydroxy stearic acid, or even 12 to 26 percent by weight quaternized dispersant and 88 to 74 percent by weight polyhydroxy stearic acid. In some embodiments component (a) is 10 to 30 percent by weight polyhydroxy stearic acid and 90 to 70 percent by weight quaternized dispersant, or even 10 to 25 percent by weight polyhydroxy stearic acid and 90 to 75 percent by weight quaternized dispersant, or even 12 to 26 percent by weight polyhydroxy stearic acid and 88 to 74 percent by weight quaternized dispersant.

Additional details on quaternary ammonium salts, examples thereof and methods of making the same can be found in U.S. Pat. Nos. 7,951,211 and 7,906,470, US published applications US 2008/0113890, US 2010/0024286, US 2012/0010112, US 2011/110860, and US 2011/0315107, and international publications WO 2010/132259, WO 2010/097624, and WO 2011/095819.

Component (b)

The compositions of the invention include a metal dialkyldithiophosphate, which may include a zinc dialkyldithiophosphate. Examples of suitable metal dialkyldithiophosphate include metal salts of Formula (VI).

(IV)

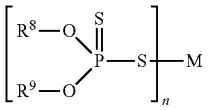

wherein $R^8$ and $R^9$ are independently hydrocarbyl groups containing 3 to 30 or to 20, to 16, or to 14 carbon atoms are readily obtainable by the reaction of phosphorus pentasulfide ($P_2S_5$) and an alcohol or phenol to form an O,O-dihydrocarbyl phosphorodithioic acid corresponding to Formula (V).

(V)

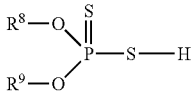

The reaction involves mixing at a temperature of 20° C. to 200° C., four moles of an alcohol or a phenol with one mole of phosphorus pentasulfide. Hydrogen sulfide is liberated in this reaction. The acid is then reacted with a basic metal compound to form the salt. The metal M, having a valence n, is generally aluminum, lead, tin, manganese, cobalt, nickel, zinc, or copper, and in some embodiments zinc. The basic metal compound is thus preferably zinc oxide, and the resulting metal compound is represented by Formula (VI).

(VI)

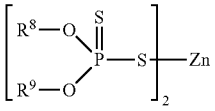

In some embodiments the $R^8$ and $R^9$ groups here are independently hydrocarbyl groups, and are typically free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethylhexanol and 2-propanol or, alternatively, a mixture of secondary alcohols such as 2-propanol and 4-methyl-2-pentanol.

In certain embodiments, the dialkyldithiophosphate may have $R^8$ and $R^9$ groups selected to reduce phosphorus volatility from the lubricant, that is, to increase retention of phosphorus in the lubricant. Suitable formulations to provide good phosphorus retention in an engine are disclosed, for instance, in US published application 2008-0015129, see, e.g., claims.

Such zinc salts are often referred to as zinc dialkyldithiophosphates (ZDDP) or simply zinc dithiophosphates (ZDP). They are well known and readily available to those skilled in the art of lubricant formulation. Further zinc dialkyldithiophosphates may be described a primary zinc dialkyldithiophosphates or as secondary zinc dialkyldithiophosphates, depending on the structure of the alcohol used in its preparation. In some embodiments the compositions of the invention include primary zinc dialkyldithiophosphates. In some embodiments the compositions of the invention include secondary zinc dialkyldithiophosphates. In some embodiments the compositions of the invention include a mixture of primary and secondary zinc dialkyldithiophosphates. In some embodiments component (b) is a mixture of primary and secondary zinc dialkyldithiophosphates where the ratio of primary zinc dialkyldithiophosphates to secondary zinc dialkyldithiophosphates (one a weight basis) is at least 1:1, or even at least 1:1.2, or even at least 1:1.5 or 1:2, or 1:10. In some embodiments component (b) is a mixture of primary and secondary zinc dialkyldithiophosphates that is at least 50 percent by weight primary, or even at least 60, 70, 80, or even 90 percent by weight primary. In some embodiments component (b) is free of primary zinc dialkyldithiophosphates.

Component (c)

The compositions of the invention include (c) a phosphorus-containing compound which is not a metal dialkyldithiophosphate.

In some embodiments the phosphorus-containing compound is a phosphate, such as zinc phosphate. In some embodiments the phosphorus-containing compound is a phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a dihydrocarbyl substituted phosphite, or a tri-hydrocarbyl substituted phosphite.

In one embodiment the phosphite is sulphur-free i.e., the phosphite is not a thiophosphite.

The phosphite having at least one hydrocarbyl group with 4 or more carbon atoms may be represented by the formula (VII) and/or (VIII).

(VII)

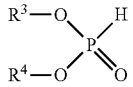

-continued (VIII)

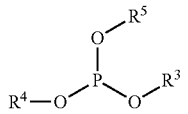

wherein at least one of $R^3$, $R^4$ and $R^5$ may be a hydrocarbyl group containing at least 4 carbon atoms and the other may be hydrogen or a hydrocarbyl group. In one embodiment both $R^3$, $R^4$ and $R^5$ are hydrocarbyl groups. The hydrocarbyl groups may be alkyl, cycloalkyl, aryl, acyclic or mixtures thereof. In the formula with all three groups $R^3$, $R^4$ and $R^5$, the compound may be a tri-hydrocarbyl substituted phosphite i.e., $R^3$, $R^4$ and $R^5$ are all hydrocarbyl groups.

Alkyl groups may be linear or branched, typically linear, and saturated or unsaturated, typically saturated. Examples of alkyl groups for $R^3$, $R^4$ and $R^5$ include octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof.

In some embodiments the phosphorus-containing compound is an amine salt of a phosphate hydrocarbon ester (i.e., an amine salt of a hydrocarbon ester of phosphoric acid). The amine salt of a phosphate hydrocarbon ester may be derived from an amine salt of a phosphate. The amine salt of the phosphate hydrocarbon ester may be represented by Formula (IX).

(IX)

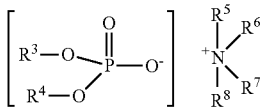

wherein: $R^3$ and $R^4$ may be independently hydrogen or hydrocarbon typically containing 4 to 40, or 6 to 30, or 6 to 18, or 8 to 18 carbon atoms, with the proviso that at least one is a hydrocarbon group; and $R^5$, $R^6$, $R^7$ and $R^8$ may be independently hydrogen or a hydrocarbyl group, with the proviso that at least one is a hydrocarbyl group. The hydrocarbon groups of $R^3$ and/or $R^4$ may be linear, branched, or cyclic.

Examples of a hydrocarbon group for $R^3$ and/or $R^4$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^3$ and/or $R^4$ include cyclopentyl, cyclohexyl, cycloheptyl, methylcyclopentyl, dimethylcyclopentyl, methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl.

In one embodiment the phosphate may be an amine salt of a mixture of monoalkyl and dialkyl phosphoric acid esters. The monoalkyl and dialkyl groups may be linear or branched.

The amine salt of a phosphate hydrocarbon ester may be derived from an amine such as a primary amine, a secondary amine, a tertiary amine, or mixtures thereof. The amine may be aliphatic, or cyclic, aromatic or non-aromatic, typically aliphatic. In one embodiment the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecylamine, as well as such fatty amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment the amines are in the form of a mixture. Examples of suitable mixtures of amines include (i) a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butylamine, tert-hexylamine, tert-octylamine (such as 1,1-dimethylhexylamine), tert-decylamine (such as 1,1-dimethyloctylamine), tert-dodecylamine, tert-tetradecylamine, tert-hexadecylamine, tert-octadecylamine, tert-tetracosanylamine, and tert-octacosanylamine.

In one embodiment a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphate hydrocarbon ester may be prepared as is described in U.S. Pat. No. 6,468,946. Column 10, lines 15 to 63 describes phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene® 81-R) to form an amine salt of a phosphate hydrocarbon ester.

Suitable phosphorus-containing compounds also include hydrocarbyl amine salts of dialkyldithiophosphoric acid. Examples of hydrocarbyl amine salts of dialkyldithiophosphoric acid are represented by Formula (X) and (XI).

(X)

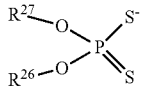

(XI)

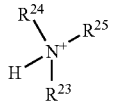

wherein $R^{26}$ and $R^{27}$ are independently branched or linear alkyl groups. $R^{26}$ and $R^{27}$ contain about 3 to about 30, preferably about 4 to about 25, more preferably about 5 to about 20, and most preferably about 6 to about 19 carbon atoms. $R^{23}$, $R^{24}$ and $R^{25}$ are as described above.

In some embodiments the hydrocarbyl amine salts of dialkyldithiophosphoric acid include but are not limited to the reaction product(s) of diheptyl or dioctyl or dinonyl dithiophosphoric acids with ethylenediamine, morpholine or Primene 81R or mixtures thereof.

In some embodiments component (c) comprises at least one member of the group selected from (i), (ii) and (iii), wherein (i), (ii) and (iii) are defined as follows:

(i) an amine salt of a phosphorus compound represented by Formula (XII)

Formula (XII)

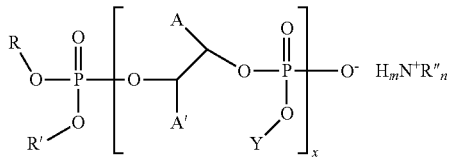

wherein A and A' are independently H, or a hydrocarbyl group containing about 1 to about 30 carbon atoms; each R and R" group are independently a hydrocarbyl group; each R' is independently R, H, or a hydroxyalkyl group; Y is independently R', or a group represented by RO(R'O)P(O)—CH(A')CH(A)- (such as $RO(R'O)P(O)—CH^2CH(CH_3)—$); x ranges from about 0 to about 1, with the proviso that when x=0, R' is a hydroxyalkyl group; and m and n are both positive non-zero integers, with the proviso that the sum of (m+n) is equal to about 4;

(ii) a sulphur-free amine salt of a phosphorus compound obtained/obtainable by a process comprising: reacting an amine with a hydroxy-substituted di-ester of phosphoric acid or a phosphorylated hydroxy-substituted di- or tri-ester of phosphoric acid; and (iii) a sulphur-free amine salt of a hydroxy-substituted di-ester of phosphoric acid.

The phosphorus-containing compound may be present at 0.01 percent by weight to 5 percent by weight, or 0.1 percent by weight to 3 percent by weight, or 0.2 percent by weight to 1.5 percent by weight, or 0.25 percent by weight to 1 percent by weight, or 0.5 percent by weight to 1 percent by weight of the described composition. The amount of component (c) may instead be described in regards to the amount of phosphorus it delivers to the composition. Component (c) may be present such that the component delivers from 50 to 2000, or from 100 to 1200, or from 200 to 900, or from 1 to 600, or from 400 to 1000 ppm of phosphorus to the composition.

In some embodiments component (c) comprises an alkyl phosphite, a phosphoric acid ester, an amine salt of a phosphoric acid ester, or some combination thereof.

Component (d)

The compositions of the invention include (d) a derivative of a hydroxyl carbonyl compound and an amine and/or an alcohol. Suitable hydroxyl carbonyl compounds include alpha hydroxyl carbonyl compounds. Suitable hydroxyl carbonyl compounds include alpha hydroxyketones and hydroxy-carboxylic acids. In some embodiments component (d) includes a derivative of a hydroxy-carboxylic acid and an amine and/or an alcohol.

Suitable acids may include from 1 to 5 or 2 carboxy groups, and from 1 to 5 or 2 hydroxy groups. In some embodiments the friction modifier is derivable from a hydroxy-carboxylic acid represented by Formula (XIII).

(XIII)

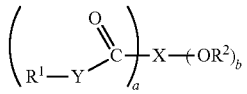

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or $>NR^3$ or two Y's together representing the nitrogen of an imide structure $R^1$—N< formed between two carbonyl groups; and each $R^1$ and $R^3$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups and further provided that at least one $R^2$ is hydrogen. In some embodiments the friction modifier is derived from the hydroxy-carboxylic acid represented by the formula described above.

The hydroxy-carboxylic acid is reacted with an alcohol and/or an amine, via a condensation reaction, forming the friction modifier additive.

In one embodiment the hydroxy-carboxylic acid is represented by Formula (IVX).

(IVX)

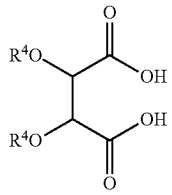

wherein each $R^4$ is independently H or a hydrocarbyl group, or wherein the $R^4$ groups together form a ring. In one embodiment, where $R^4$ is H, the condensation product is optionally further functionalized by acylation or reaction with a boron compound. In another embodiment the friction modifier is not borated.

In any of the embodiments above, the hydroxy-carboxylic acid may be tartaric acid, citric acid, malic acid, glycolic acid, oligomers thereof, or combinations thereof, and may also be a reactive equivalent of such acids (including esters, acid halides, or anhydrides). In some embodiments, the hydroxy-carboxylic acid may be tartaric acid, citric acid, or combinations thereof, or a reactive equivalent of such acids (including esters, acid halides, or anhydrides). The resulting friction modifiers may include imide, di-ester, di-amide, or ester-amide derivatives of tartaric acid, citric acid, or mixtures thereof. In one embodiment the derivative of hydroxy-carboxylic acid includes an imide, a di-ester, a di-amide, an imide amide, an imide ester or an ester-amide derivative of tartaric acid or citric acid.

The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched.

The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms.

The alcohols and amines may be linear or branched, and, if branched, the branching may occur at any point in the chain and the branching may be of any length. In some embodiments the alcohols and/or amines used include branched compounds, and in still other embodiments, the alcohols and amines used are at least 50%, 75% or even 80% branched. In other embodiments the alcohols are linear.

In some embodiments, the alcohol and/or amine have at least 6 carbon atoms. Accordingly, certain embodiments of the invention employ the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments of the invention employ the product prepared from linear alcohols of at least 6 carbon atoms, for instance, linear $C_{6-18}$ or $C_{8-18}$ alcohols or linear $C_{12-16}$ alcohols, either as single materials or as mixtures.

The tartaric acid used for preparing the tartrates, tartrimides, or tartramides of the invention can be the commercially available type (obtained from Sargent Welch), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives can also be prepared from functional equivalents to the diacid readily apparent to those skilled in the art, such as esters, acid chlorides, anhydrides, etc.

In one embodiment the friction modifier component of the present invention includes oleyl tartrimide, stearyl tartrimide, 2-ethylhexyl tartrimide, or combinations thereof. The friction modifier may be present in the compositions of the present invention at levels of at least 0.1, 0.15, 0.2, 0.3, 0.5 or even 1.0 percent by weight. The friction modifier may be present at amounts up to, or even less than, 10, 9, 8, 7.5, 5, or even 4 or 3 percent by weight.

The compositions of the present invention, and specifically the friction modifier component, may optionally include one or more additional friction modifiers. These additional friction modifiers may or may not have the solubility and/or compatibility issues of the friction modifiers described above. Also, these additional friction modifiers may or may not help to stabilize the overall composition. These additional friction modifiers may include esters of polyols such as glycerol monooleates, as well as their borated derivatives; fatty phosphites; fatty acid amides such as oleyl amides; borated fatty epoxides; fatty amines, including borated alkoxylated fatty amines; sulfurized olefins; and mixtures thereof.

Esters of polyols include fatty acid esters of glycerol. These can be prepared by a variety of methods well known in the art. Many of these esters, such as glycerol monooleate and glycerol mono-tallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Useful $C_8$ to $C_{22}$ fatty acids are those of the formula R—COOH wherein R is alkyl or alkenyl.

The fatty acid monoester of glycerol is useful. Mixtures of mono and diesters may be used. Mixtures of mono- and diester can contain at least about 40% of the monoester. Mixtures of mono- and diesters of glycerol containing from about 40% to about 60% by weight of the monoester can be used. For example, commercial glycerol monooleate containing a mixture of from 45% to 55% by weight monoester and from 55% to 45% diester can be used.

Useful fatty acids are oleic, stearic, isostearic, palmitic, myristic, palmitoleic, linoleic, lauric, linolenic, and eleostearic, and the acids from the natural products, such as tallow, palm oil, olive oil, peanut oil.

Although tartrates and esters of polyols such as glycerol monooleate may appear to have superficially similar molecular structures, it is observed that certain combinations of these materials may actually provide better performance, e.g., in wear prevention, than either material used alone.

Fatty acid amides have been discussed in detail in U.S. Pat. No. 4,280,916. Suitable amides are $C_8$-$C_{24}$ aliphatic monocarboxylic amides and are well known. Reacting the fatty acid base compound with ammonia produces the fatty amide. The fatty acids and amides derived there from may be either saturated or unsaturated. Important fatty acids include lauric acid ($C_{12}$), palmitic acid ($C_{16}$), and stearic acid ($C_{18}$). Other important unsaturated fatty acids include oleic, linoleic and linolenic acids, all of which are $C_{18}$. In one embodiment, the fatty amides of the instant invention are those derived from the $C_{18}$ unsaturated fatty acids.

The fatty amines and the diethoxylated long chain amines such as N,N-bis-(2-hydroxyethyl)-tallowamine themselves are generally useful as components of this invention. Both types of amines are commercially available. Fatty amines and ethoxylated fatty amines are described in greater detail in U.S. Pat. No. 4,741,848.

In some embodiments the compositions of the present invention do not include any of these optional friction modifiers and in other embodiments, one or more of any of the optional friction modifiers listed herein are not present in the compositions of the present invention.

In other embodiments an additional friction modifier is present, and that friction modifier is an amide of an aliphatic carboxylic acid containing 6 to 28 carbon atoms. In other embodiments the additional friction modifier is an amide of stearic acid, oleic acid, or combinations thereof.

The Oil of Lubricating Viscosity

One component of the compositions of the invention is an oil of lubricating viscosity, which can be present in a major amount, for a lubricant composition, or in a concentrate forming amount, for a concentrate and/or additive composition.

Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the overall composition. The base oil component generally makes up 100 parts by weight (pbw) of the overall composition with the pbw ranges for the other components being provided with this 100 pbw of base oil in mind. In other embodiments the pbw ranges of the various components, including the base oils, are provided such that the total of the pbw of all components is 100, and thus the pbw values are equivalent to percent by weight values. The pbw ranges provided for the various components described below may be taken either way, however in most embodiments they are to be read so as to be equivalent to percent by weight values.

The oil of lubricating viscosity may include natural and synthetic oils, oil derived from hydrocracking, hydrogenation, and hydrofinishing, unrefined, refined and refined oils or mixtures thereof. Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Natural oils useful as the oil of lubricating viscosity include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic naphthenic types and oils derived from coal or shale or mixtures thereof.

Synthetic oils of lubricating viscosity include hydrocarbon oils such as polymerized and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated biphenyl ethers and alkylated biphenyl sulfides and the derivatives, analogs and homologs thereof or mixtures thereof. In some embodiments the oil of lubricating viscosity used in the invention is a synthetic oil that includes polymerized polyisobutylene, and in some embodiments the oil of lubricating viscosity used in the invention is a synthetic oil that includes polymerized polyisobutylene and a polyalphaolefin).

Another synthetic oil of lubricating viscosity include polyol esters other than the hydrocarbyl-capped polyoxyalkylene polyol as disclosed herein, dicarboxylic esters, liquid esters of phosphorus-containing acids (e.g., tricresyl phosphate, trioctyl phosphate, and the diethyl ester of decane phosphonic acid), or polymeric tetrahydrofurans. Synthetic conventional oil of lubricating viscosity also include those produced by Fischer-Tropsch reactions and typically may be hydroisomerised Fischer-Tropsch hydrocarbons or waxes. In one embodiment, the oil of lubricating viscosity may be prepared by a Fischer-Tropsch gas-to-liquid synthetic procedure as well as other gas-to-liquid oils.

Oils of lubricating viscosity may further be defined as specified in the American Petroleum Institute (API) Base Oil Interchangeability Guidelines. The five base oil groups are as follows: Group I (sulfur content>0.03 percent by weight, and/or <90 percent by weight saturates, viscosity index 80-120); Group II (sulfur content≤0.03 percent by weight and ≥90 percent by weight saturates, viscosity index 80-120); Group III (sulfur content≤0.03 percent by weight and ≥90 percent by weight saturates, viscosity index>120); Group IV (all polyalphaolefins, or PAO, such as PAO-2, PAO-4, PAO-5, PAO-6, PAO-7 or PAO-8); and Group V. The oil of lubricating viscosity includes API Group I, Group II, Group III, Group IV, Group V oil or mixtures thereof. In one embodiment, the oil of lubricating viscosity is an API Group I, Group II, Group III, Group IV oil or mixtures thereof. Alternatively, the oil of lubricating viscosity is often an API Group II, Group III or Group IV oil or mixtures thereof.

In some embodiments the lubricating oil component of the present invention includes a Group II or Group III base oil, or a combination thereof. These are classifications established by the API (American Petroleum Institute). Group III oils contain <0.03 percent sulfur and >90 percent saturates and have a viscosity index of >120. Group II oils have a viscosity index of 80 to 120 and contain <0.03 percent sulfur and >90 percent saturates. The oil can also be derived from the hydroisomerization of wax, such as slack wax or a Fischer-Tropsch synthesized wax. Such "Gas-to-Liquid" oils are typically characterized as Group III.

The compositions of the present invention may include some amount of Group I base oils, and even Group IV and Group V base oils. Polyalphaolefins are categorized as Group IV. Group V encompasses "all others". However, in some embodiments the lubricating oil component of the invention contains no more than 20, 10, 5, or even 1 percent by weight Group I base oil. These limits may also apply to Group IV or Group V base oils. In other embodiments the lubricating oil present in the compositions of the invention is at least 60, 70, 80, 90, or even 95 percent by weight Group II and/or Group III base oil. In some embodiments the lubricating oil present in the compositions of the invention is essentially only Group II and/or Group III base oil, where small amounts of other types of base oils may be present but not in amounts that significantly impact the properties or performance of the overall composition.

In some embodiments the compositions of the invention include some amount of Group I and/or Group II base oils. In other embodiments the compositions of the invention are lubricating compositions where the oil of lubricating viscosity is primarily Group I and/or Group II base oils, or even essentially Group I and/or Group II base oils, or even exclusively Group I and/or Group II base oils.

In some embodiments the compositions of the invention include some amount of Group I and/or Group II base oils. In other embodiments the compositions of the invention are lubricating compositions where the oil of lubricating viscosity is primarily Group I and/or Group II base oils, or even essentially Group I and/or Group II base oils, or even exclusively Group I and/or Group II base oils.

The various described oils of lubricating viscosity may be used alone or in combinations. When referring to additive compositions, the oil of lubricating viscosity may be used in the range of about 1 percent by weight to about 50 percent by weight, and in another embodiment, in the range of about 10 percent by weight to about 50 percent by weight, in another embodiment in the range of about 40 percent by weight to about 50 percent by weight of the lubricant. When referring to lubricant compositions, the oil of lubricating viscosity may be used in the range of about 70 percent by weight to about 99 percent by weight, and in another embodiment, in the range of about 75 percent by weight to about 98 percent by weight, in another embodiment in the range of about 88 percent by weight to about 97 percent by weight of the lubricant.

Additional Additives

The composition can optionally comprise other performance additives as well. The other performance additives can comprise one or more of and/or additional metal deactivators, conventional detergents (detergents prepared by processes known in the art), dispersants, viscosity modifiers, friction modifiers, antiwear agents, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

In particular, further dispersants may be employed in the compositions described above. Such additional dispersants include non-quaternized ashless-type dispersants, characterized by a polar group attached to a relatively high molecular weight hydrocarbon chain. Typical non-quaternized ashless dispersants include N-substituted long chain alkenyl succinimides. Examples of N-substituted long chain alkenyl succinimides include PIB succinimide with number average molecular weight of the PIB substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a polyethylene polyamine or an aromatic polyamine, such as amino diphenylamine (ADPA). In some embodiments the compositions of the invention further include a non-quaternized succinimide dispersant, and this non-quaternized succinimide dispersant may be derived from PIB.

In one embodiment, the lubricant composition can further comprise the non-quaternized reaction product of a PIB succinic anhydride and an amine, preferably a polyamine, and preferably an aliphatic polyamine, such as ethylene polyamine (i.e., a polyethylene polyamine), a propylene polyamine, a butylene polyamine, or a mixture of two or more thereof. The aliphatic polyamine may be ethylene polyamine. The aliphatic polyamine may be selected from ethylenediamine, diethylenetriamine, triethylenetetramine, tetraethylenepentamine, pentaethylenehexamine, polyamine still bottoms, or a mixture of two or more thereof. In some embodiments the non-quaternized dispersant comprises the reactrion product of a PIB succinic anhydride and an amine that includes triethylenetetramine, pentaethylenehexamine, polyethylene polyamine bottoms, or some combination thereof.

Another class of non-quaternized ashless dispersant are the Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, phosphorus compounds and/or metal compounds.

In some embodiments the lubricant compositions of the invention may also comprise an antioxidant, for example an ashless antioxidant. Suitable examples include hindered phenols, diaryl amines, sulfurized olefins, and combinations thereof.

In some embodiments the compositions of the invention include (a) the dispersant comprising a quaternary ammonium salt, (b) the metal dialkyldithiophosphate, (c) the phosphorus-containing compound that is not a metal dialkyldithiophosphate, (d) the derivative of a hydroxy carbonyl compound, such as a hydroxy-carboxylic acid, and an amine and/or an alcohol, and a mixtures of one or more performance additives which may include one or more additional dispersants, for example an ashless nitrogen-continuing ashless dispersant such as a succinimide dispersant, and one or more ashless antioxidants, such as a hindered phenol, diaryl amine, or sulfurized olefin. These compositions may be either the additive compositions or the lubricating compositions described above (the additional additives may be present in both types of compositions).

In some embodiments the compositions of the present invention include invention include (a) the dispersant comprising a quaternary ammonium salt, (b) the metal dialkyldithiophosphate, (c) the phosphorus-containing compound that is not a metal dialkyldithiophosphate, (d) the derivative of a hydroxy-carboxylic acid and an amine and/or an alcohol, and an additional additive package.

This additional additive package may include a non-quaternized succinimide dispersant. In some embodiments it also includes a mixture of one or more detergents (for example one or more calcium phenates, calcium sulfonates, magnesium phenates/saligenins, or any combination thereof), a seal swell agent, an alkyl borate, a succinimide anhydride, a mixture of one or more antioxidants (from example one or more aminic antioxidants, phenolic antioxidants, sulfurized olefin antioxidants, or any combination thereof), an additional friction modifier (for example a fatty amine friction modifier), a mixture of one or more viscosity modifiers, a pour point depressant, and an antifoam agent.

In some embodiments the additional additive composition includes a non-quaternized succinimide dispersant, a mixture of one or more detergents (for example a calcium phenate, a calcium sulfonate, a magneiusm phenate/saligenin, or a combination thereof), a seal swell agent, an alkyl borate, a succinimide anhydride, a mixture of one or more antioxidants (from example an aminic antioxidant, a phenolic antioxidant, a sulfurized olefin antioxidant, or a combintion thereof), an additional frcition modifier (for example a fatty amine friction modifier), and an antifoam agent. In some emboidments the additional additive package includes a non-quaternized succinimide dispersant, a mixture of one or more detergents (for example one or more calcium phenates, a calcium sulfonate, or a combination thereof), a mixture of one or more antioxidants (from example an aminic antioxidant, a phenolic antioxidant, a sulfurized olefin antioxidant, or a combintion thereof), an additional friction modifier (for example a fatty amine friction modifier), a mixture of one or more viscsoity modifiers, a pour point depressant, and an antifoam agent.

In any of these embodiments, the total combined amount of the optional performance additives present in one embodiment is from 0 or 0.01 wt. % to 50 wt. %, in another embodiment 0 or 0.01 to 40 wt. %, in another embodiment 0 or 0.01 to 30 wt. %, and in another embodiment 0.05 or 0.1 or 0.5 to 20 wt. % of the overall composition. In one embodiment, the total combined amount of the additional performance additive compounds present on an oil free basis ranges from 0 wt % to 25 wt % or 0.01 wt % to 20 wt % of the composition. Although, one or more of the other performance additives may be present, it is common for the other performance additives to be present in different amounts relative to each other.

Industrial Application

The compositions described herein can be used as lubricants in mechanical devices, including as a lubricant for an internal combustion engine. The lubricating compositions described herein can be added to an internal combustion engine, or more specifically, to the lubrication system of an internal combustion engine, thus lubricating the engine and improving its operation. This improvement in the operation of the engine may be described as reducing wear of engine parts over time, reducing deposit build up on engine surfaces, and also reducing damage to seals, particularly compared to engines operated with lubricants that contain a quaternary ammonium salt, but which do not otherwise meet the requirements of the invention.

Likewise, the invention provides a method of improving the overall performance of a lubricant composition, as the lubricant compositions of the invention provide balanced performance across the areas of deposit control, seal compatibility, and antiwear. More specifically the lubricant compositions of the invention provide the high levels of deposit control and antiwear protection that may be expected from compositions containing a quaternary ammonium salt dispersant, but without the seal compatibility issues that come along with it.

The invention further provides for the use of the described compositions as to improve the seal performance of a quaternary ammonium salt containing composition. More specifically, the quaternary ammonium salt containing composition may be improved by reducing seal compatibility issues when the features of the present invention are applied. It is noted that similar deposit control performance can sometimes be achieved using more traditional non-quaternized dispersants (see Example Set B below). However the compositions of the invention allow at least as good deposit performance to be achieved which a reduced amount of dispersants. That is, in some embodiments, the invention allows of the use of a smaller total amount of dispersant (including the combination of quaternized and non-quaternized dispersant), compared to a composition that uses only non-quaternized dispersant, while still providing at least as good deposit control.

It is also noted that the additive compositions and/or additive concentrates described herein may be used in any of the mean described above, by first combining the additive compositions and/or additive concentrates with an appropriate amount of lubricating oil, in order to result in the lubricating compositions of the invention, or even in order to result in a booster and/or top treat composition that can be added to a lubricating composition, thus transforming it into a the lubricating composition of the invention.

EXAMPLES

The invention will be further illustrated by the following examples, which set forth particularly advantageous embodiments. While the examples are provided to illustrate the invention, they are not intended to limit it.

Example Set A

Six examples are prepared including two comparative examples (Examples A-1 and A-2) and four inventive examples (A-3, A-4, A-5, and A-6). The examples are tested to determine their seal compatibility by VW PV 3344, a 282 hour test well known in the industry.

The example set is designed to evaluate the performance of compositions that include (a) a dispersant comprising a quaternary ammonium salt, (b) a metal dialkyldithiophosphate, (c) a phosphorus-containing compound, and (d) a derivative of a hydroxy-carboxylic acid and an amine and/or an alcohol. Two different levels of component (a) are evaluated as are two different levels of component (b). The two comparative examples demonstrate what happens to seal performance when one of the inventions required components, here component (c) is omitted. The formulations and results for example set A are summarized in Table 1 below where are values are percent by weight on an actives basis.

TABLE 1

Example Set A Formulations and Results

| | A-1 | A-2 | A-3 | A-4 | A-5 | A-6 |
|---|---|---|---|---|---|---|
| Comp (a)[1] | 3.45 | 3.45 | 3.45 | 3.45 | 3.9 | 3.9 |
| Comp (b)[2] | 0.83 | 0.83 | 0.38 | 0.38 | 0.38 | 0.38 |
| Comp (c)[3] | 0 | 0 | 0.83 | 0.83 | 0.83 | 0.83 |
| Comp (d)[4] | 0.50 | 0.50 | 0.50 | 0.50 | 0.50 | 0.50 |
| Non-Quat Dispersant[5] | 1.40 | 2.80 | 1.40 | 2.80 | 1.40 | 2.80 |
| Package A[6] | 6.08 | 6.08 | 6.08 | 6.08 | 6.08 | 6.08 |
| Oil[7] | 87.74 | 86.34 | 87.36 | 85.96 | 86.91 | 85.51 |
| Seal Compatibility Test Results | FAIL | FAIL | PASS | PASS | PASS | PASS |

[1]Comp (a) is a mixture of a quaternary ammonium salt dispersant derived from polyhydroxy stearic acid and a polyamine, and polyhydroxy stearic acid. In examples A-1 to A-4 the mixture is about 13 percent by weight quaternary ammonium salt dispersant. In examples A-5 and A-6 the mixture is about 23 percent by weight quaternary ammonium salt dispersant.

[2]Comp (b) is a mixture of zinc dialkyldithiophosphates.

[3]Comp (c) is an alkyl phosphite.

[4]Comp (d) is a carboxylic acid ester, derived from tartaric acid and a mixture of linear and branched alcohols.

[5]The Non-Quat Dispersant is a non-quaternized succinimide dispersant prepared from PIB and a polyethylene polyamine.

[6]Package A is a package of additional additives, not believed to impact the benefits provided by the invention, but which are present in order for the examples to be considered fully formulated lubricating compositions. Each example in Example Set A includes the same Package A, which includes a mixture of phenate and sulfonate detergents, a seal swell agent, a borate ester, a PIB succinic anhydride, a mixture of aminic, phenolic and sulfurized antioxidants, an additional friction modifier, and an antifoam agent.

[7]The Oil component is the base oil used in each example along with any diluent oil that comes along from the other components. The percent values for the other components are given on an actives basis (i.e. oil free basis) so the base oil and any balance is accounted for here.

The results show that the compositions of the invention provide good seal compatibility and that removing one of the inventions required components, here component (b), results in poor seal compatibility.

Example Set B

Ten examples are prepared including eight comparative examples (Examples B-1 to B-8) and two inventive examples (B-9 and B-10). The examples are tested to determine their seal compatibility by VW PV 3344, a 282 hour test well known in the industry and were also tested to determine their deposit control and wear performance, using Renault GFCLU27 engine testing using two different industry known rating techniques (referred to below as MCT A and MCT B), panel coker testing based on GFC Lu-29-T-97 (referred to below as PC Deposit and PC Rating), hot tube testing used to evaluate the deposit forming tendency of an oil when subjected to high temperatures in an air environment (referred to below as HT 300), and a standardized HFRR test method using a 200 gram load, a 75 minute duration, a 20 hertz frequency, held at to 40° C. for 15 minutes and then ramped to 160° C. at 2° C. per minute, with a standard steel ball on a steel surface to measure the coefficient of friction and the resulting surface wear scar (referred to below as COF and Wear Scar). Higher values in the MCT A and MCT B results, the PC Rating results, and the Hot Tube 300 results, all indicate better relative performance for that sample. Lower values in the PC Deposit, the coefficient of friction (COF), and wear scar (reported in microns) results indicate better relative performance for that sample.

The example set is designed to evaluate the performance of compositions that include (a) a dispersant comprising a quaternary ammonium salt, (b) a zinc dialkyldithiophosphate, (c) a phosphorus-containing compound, and (d) a derivative of a hydroxy-carboxylic acid and an amine and/or an alcohol. Two different levels of component (a) are evaluated as are two different levels of component (b). The eight comparative examples demonstrate what happens to performance when one or more of the inventions required components is omitted. The formulations and results for example set B are summarized in Table 2 below where are values are percent by weight on an actives basis, where NT stands for "not tested".

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); (ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); (iii) hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

TABLE 2

Example Set B Formulations and Results

| | B-1 | B-2 | B-3 | B-4 | B-5 | B-6 | B-7 | B-8 | B-9 | B-10 |
|---|---|---|---|---|---|---|---|---|---|---|
| Comp (a)[1] | 0 | 0.45 | 0.90 | 0 | 0 | 0 | 0 | 0 | 0.45 | 0.90 |
| Comp (b)[2] | 0.83 | 0.83 | 0.83 | 0.83 | 0.83 | 0.38 | 0.38 | 0.38 | 0.38 | 0.38 |
| Comp (c)[3] | 0 | 0 | 0 | 0 | 0 | 0.83 | 0.83 | 0.83 | 0.83 | 0.83 |
| Comp (d)[4] | 0 | 0 | 0 | 0 | 0 | 0.50 | 0.50 | 0.50 | 0.50 | 0.50 |
| NQ Disp[5] | 2.80 | 2.80 | 2.80 | 3.25 | 3.70 | 2.80 | 3.25 | 3.70 | 2.80 | 2.80 |
| Package B[6] | 6.23 | 6.23 | 6.23 | 6.23 | 6.23 | 6.23 | 6.23 | 6.23 | 6.23 | 6.23 |
| Oil[7] | 90.14 | 89.69 | 89.24 | 89.69 | 89.24 | 89.26 | 88.81 | 88.36 | 88.81 | 88.36 |
| MCT A | 7.44 | 7.55 | 8.81 | 7.42 | 7.65 | 7.96 | 8.06 | 7.77 | 7.19 | 7.41 |
| MCT B | 8.48 | 8.79 | 8.79 | 8.51 | 8.62 | 8.97 | 9.03 | 8.88 | 8.29 | 8.63 |
| PC Deposit | 115 | 241 | 111 | 90 | 72 | 56 | 94 | 62 | 64 | 64 |
| PC Rating | 4 | 4 | 12 | 8 | 9 | 15 | 28 | 21 | 16 | 25 |
| HT 300 | 76.28 | 81.28 | 91.74 | 69.22 | 60.94 | 88.32 | 93.27 | 94.77 | 89.25 | 96.66 |
| COF (avg) | 0.126 | 0.130 | 0.127 | 0.124 | 0.128 | 0.107 | 0.108 | 0.107 | 0.111 | 0.106 |
| Wear Scar | 150 | 155 | 141 | 138 | 138 | 137 | 150 | 114 | 131 | 124 |

[1]Comp (a) is a quaternary ammonium salt dispersant derived from polyhydroxy stearic acid and a polyamine.

[2]Comp (b) is a mixture of zinc dialkyldithiophosphates.

[3]Comp (c) is an alkyl phosphite.

[4]Comp (d) is a carboxylic acid ester, derived from tartaric acid and a mixture of linear and branched alcohols.

[5]The NQ Disp is a non-quaternized succinimide dispersant prepared from PIB and a polyethylene polyamine.

[6]Package B is a package of additional additives, not believed to impact the benefits provided by the invention, but which are present in order for the examples to be considered fully formulated lubricating compositions. Each example in Example Set B includes the same Package B, which includes a mixture of phenate and sulfonate detergents, a mixture of aminic, phenolic and sulfurized antioxidants, an additional friction modifier, a mixture of viscosity modifiers, a pour point depressant, and an antifoam agent. Package B includes many of the same additives as Package A in Example Set A above, but does not include all the additives of Package A and also include some additives not present in Package A, while also using common additives in different amounts. In other words they are different additive packages and help show that the details of the additional additive package used do not impact the benefits provided by the invention.

[7]The Oil component is the base oil used in each example along with any diluent oil that comes along from the other components. The percent values for the other components are given on an actives basis (i.e. oil free basis) so the base oil and any balance is accounted for here.

The results show that the compositions of the invention provide good deposit control and wear performance and that removing one or more of the inventions required components results in poor performance. The results also so that the composition of the invention can provide good performance when using a combination of quaternized and non-quaternized dispersants, and can provide that good performance even when using an overall reduced amount of dispersant, compared to compositions using higher amounts of non-quaternized dispersants only.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

What is claimed is:

1. A lubricant composition comprising a major amount of an oil of lubricating viscosity;

(a) 0.3 to 5 percent by weight of a dispersant comprising a quaternary ammonium salt;

(b) 0.1 to 1.5 percent by weight of a zinc dialkyldithiophosphate;

(c) 0.5 to 1.0 percent by weight of a phosphorus-containing compound that is not a zinc dialkyldithiophosphate, comprising an alkyl phosphite;

(d) 0.5 to 1.0 percent by weight of a derivative of a hydroxyl-carboxylic acid and an alcohol; and (e) 1.0 to 5 percent by weight of a non-quaternized dispersant comprising a succinimide dispersant prepared from PIB and a polyether polyamine;

wherein said percentages are based on the overall lubricant composition; and wherein the weight ratio of component (c) to component (b) is at least 1.5:1.

2. The lubricant composition of claim 1 wherein component (a) comprises a quaternary ammonium salt comprising the reaction product of: (i) a compound comprising at least one tertiary amino group; and (ii) a quaternizing agent suitable for converting the tertiary amino group of compound (i) to a quaternary nitrogen group.

3. The lubricant composition of claim 1 wherein component (a) comprises the reaction product of (i) the reaction product of a polyhydroxy stearic acid and a polyamine where the resulting product has at least one tertiary amino group or at least one amino group that may be alkylated to a tertiary amino group; and (ii) a quaternizing agent suitable for converting the tertiary amino group of compound to a quaternary nitrogen group, and wherein component (a) may optionally further comprises a polyhydroxy stearic acid.

4. The lubricant composition of claim 1 wherein the zinc dialkyldithiophosphate where each of the alkyl groups are branched and contain from 4 to 12 carbon atoms.

5. The lubricant composition of claim 1 wherein component (d) comprises a compound derived from (i) an alcohol and (ii) a hydroxy-carboxylic acid represented by the formula:

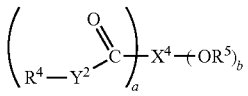

wherein: a and b may be independently integers of 1 to 5; $X^4$ may be an aliphatic or alicyclic group, or an aliphatic or alicyclic group containing an oxygen atom in the carbon chain, or a substituted group of the foregoing types, said group containing up to 6 carbon atoms and having a+b available points of attachment; each $Y^2$ may be independently —O—, >NH, or >$NR^6$ or two Ys together representing the nitrogen of an imide structure $R^4$—N<formed between two carbonyl groups; and each $R^4$ and $R^6$ may be independently hydrogen or a hydrocarbyl group, provided that at least one $R^4$ and $R^6$ group may be a hydrocarbyl group; each $R^5$ may be independently hydrogen, a hydrocarbyl group or an acyl group, further provided that at least one —$OR^5$ group is located on a carbon atom within $X^4$ that is α or β to at least one of the —C(O)—$Y^2$—$R^1$ groups, and further provided that at least one $R^5$ is hydrogen.

6. The lubricant composition of claim 1 further comprising:

one or more antioxidants, one or more detergents, one or more friction modifiers other than component (d), one or more pour point depressants, one or more viscosity modifiers, one or more antifoam agents, one or more dispersants other than component (a), one or more antiwear agents other than components (b) and (c), or any combination thereof.

7. The lubricant composition of claim 1 wherein each of the alkyl groups of the zinc-dialkyldithiophosphate are branched and contain from 3 to 12 carbon atoms;

wherein component (d) comprises a compound derived from (i) an alcohol and (ii) a hydroxy-carboxylic acid represented by the formula:

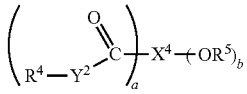

wherein: a and b may be independently integers of 1 to 5; $X^4$ may be an aliphatic or alicyclic group, or an aliphatic or alicyclic group containing an oxygen atom in the carbon chain, or a substituted group of the foregoing types, said group containing up to 6 carbon atoms and having a+b available points of attachment; each $Y^2$ may be independently —O—, >NH, or >$NR^6$ or two Ys together representing the nitrogen of amine an imide structure $R^4$—N<formed between two carbonyl groups; and each $R^4$ and $R^6$ may be independently hydrogen or a hydrocarbyl group, provided that at least one $R^4$ and $R^6$ group may be a hydrocarbyl group; each $R^5$ may be independently hydrogen, a hydrocarbyl group or an acyl group, further provided that at least one —$OR^5$ group is located on a carbon atom within $X^4$ that is α or β to at least one of the —C(O)—$Y^2$—$R^1$ groups, and further provided that at least on $R^5$ is hydrogen.

8. A method of lubricating an internal combustion engine comprising the step of supplying to an internal combustion engine the lubricant composition of claim 1.

9. A method of improving the overall performance of a lubricant composition balanced across the areas of deposit control, seal compatibility, and antiwear, wherein said method comprises the step of adding to said lubricant the additive composition of claim 1.

* * * * *